US007547250B1

(12) United States Patent
O'Neill et al.

(10) Patent No.: US 7,547,250 B1
(45) Date of Patent: Jun. 16, 2009

(54) SLEEVE EXTENDING THROUGH A FLEXIBLE MATERIAL SIDE WALL OF AN OUTDOOR ENCLOSURE FOR RECEIVING AN AIR CONDITIONER

(76) Inventors: Bethan O'Neill, 3099 Dean Rd., Lambertville, MI (US) 48144; Kenneth J. O'Neill, 3099 Dean Rd., Lambertville, MI (US) 48144

( * ) Notice: Subject to any disclaimer, the term of this patent is extended or adjusted under 35 U.S.C. 154(b) by 680 days.

(21) Appl. No.: 10/730,457

(22) Filed: Dec. 8, 2003

(51) Int. Cl.
*F24F 7/00* (2006.01)

(52) U.S. Cl. ..... 454/270; 454/271; 454/234

(58) Field of Classification Search ..... 454/234, 454/270, 271, 236; 52/198, 196; 135/906
See application file for complete search history.

(56) References Cited

U.S. PATENT DOCUMENTS

| | | | | | |
|---|---|---|---|---|---|
| 2,910,994 | A | * | 11/1959 | Joy | 52/2.11 |
| 2,939,467 | A | * | 6/1960 | Meyer et al. | 52/2.13 |
| 3,024,796 | A | * | 3/1962 | Bird | 52/2.14 |
| 3,159,165 | A | * | 12/1964 | Cohen et al. | 52/1 |
| 3,164,078 | A | * | 1/1965 | Hung | 454/271 |
| 3,254,457 | A | * | 6/1966 | Gedney | 52/2.14 |
| 3,283,691 | A | * | 11/1966 | Reiter | 137/75 |
| 3,335,529 | A | * | 8/1967 | Gedney | 52/2.14 |
| 3,766,844 | A | * | 10/1973 | Donnelly et al. | 454/238 |
| 4,000,749 | A | * | 1/1977 | Busco | 600/21 |
| 4,026,286 | A | * | 5/1977 | Trexler | 128/205.26 |
| 4,255,912 | A | | 3/1981 | Kovacs | |
| 4,607,655 | A | | 8/1986 | Wagner et al. | |
| 4,625,468 | A | * | 12/1986 | Hampel | 52/2.24 |
| 4,773,191 | A | | 9/1988 | Slack | |
| 4,852,598 | A | * | 8/1989 | Griesenbeck | 135/137 |
| 4,889,171 | A | | 12/1989 | Minimo | |
| 4,926,893 | A | * | 5/1990 | Klopfenstein et al. | 135/157 |
| 5,062,424 | A | | 11/1991 | Hooker | |
| 5,187,950 | A | * | 2/1993 | Weldon | 62/449 |
| 5,331,991 | A | * | 7/1994 | Nilsson | 135/93 |
| 5,535,559 | A | * | 7/1996 | Nielsen et al. | 52/199 |
| 5,813,160 | A | * | 9/1998 | Thoelke | 43/1 |
| 5,964,222 | A | | 10/1999 | Kotliar | |
| 6,021,794 | A | * | 2/2000 | Guerra | 135/95 |
| 6,192,633 | B1 | * | 2/2001 | Hilbert | 52/2.18 |
| 6,508,850 | B1 | | 1/2003 | Kotliar | |

* cited by examiner

*Primary Examiner*—Derek S Boles
(74) *Attorney, Agent, or Firm*—Young Basile

(57) ABSTRACT

A portable outdoor enclosure protects occupants from at least some elements of nature and includes a wall panel forming an outer wall of the enclosure. The wall panel has an opening formed of sufficient size to allow an air conditioning unit to be inserted through the opening in the flexible material wall panel. A sleeve of flexible material is connected to the wall panel and extends in at least one of an inwardly direction and an outwardly direction. The sleeve includes at least one outer peripheral end spaced from the side wall capable of being snugly engaged with an external surface of an air conditioning unit to be installed through the sleeve. At least one flap can be provided for covering the opening through the wall panel when the air conditioning unit is not installed.

20 Claims, 2 Drawing Sheets

SLEEVE EXTENDING THROUGH A FLEXIBLE MATERIAL SIDE WALL OF AN OUTDOOR ENCLOSURE FOR RECEIVING AN AIR CONDITIONER

FIELD OF THE INVENTION

The present invention relates to an opening formed in the flexible material wall panel of an outdoor enclosure for protecting occupants from at least some elements of nature allowing an air conditioning unit to be inserted through the opening, and more particularly to a sleeve for sealingly securing, by tightening at least one, and preferably both inner and outer, peripheral ends of a hollow flexible material sleeve extending through the wall panel, against an external surface of the air conditioning unit.

BACKGROUND OF THE INVENTION

Enclosures of flexible material are commercially available in various sizes to protect one or more people from the elements while camping and enjoying the outdoors. Typically, the enclosures are provided in a wide variety of structural configurations depending on the size desired and the number of people to be sheltered. The enclosures typically can be converted from an erected configuration to a more compact disassembled configuration for easy transport. The materials used for the outdoor shelter enclosures can be canvas, nylon, or any other suitable material commercially available, either inherently water resistant or waterproof material, or material treated in order to make the material water resistant or waterproof to the degree desired.

One problem associated with camping is the lack of environmental control over the interior of the enclosure. In certain locations, and during certain seasons, the temperature in portable outdoor enclosures made of flexible material can become oppressively warm and humid. Unfortunately, portable flexible material enclosures for outdoor use do not include any adaptations permitting the use of any type of commercially available air conditioning equipment, even when the electrical power necessary to operate an air conditioning unit is readily available.

SUMMARY OF THE INVENTION

The present invention relates to an opening formed in the flexible material wall panel of an outdoor enclosure, such as a tent used for camping, allowing a window air conditioning unit to be inserted through the opening and sealingly secured to the wall panel of the outdoor enclosure by tightening inner and outer peripheral ends of a sleeve against an external surface of the window air conditioning unit. The window air conditioning unit can be supported on any suitable support structure at the appropriate height. A flap of material can be provided for covering the opening when the window air conditioning unit is not installed. The flap can be attached to the wall panel by any suitable means, such as by velcro, snaps, zippers, fabric ties, or the like. The flap can be left hanging free, rolled, or folded in a storage position when not covering the opening through the wall panel. In the preferred configuration, a flap of material can be provided on an inside surface and an outside surface of the wall panel in order to completely enclose the sleeve of flexible material between the inner and outer flaps when not in use. If the enclosure includes screen material in upper portions for ventilation, the enclosure can require attachment of plastic over the screened area using any suitable fasteners in order to keep the cool air enclosed within the structure. The flexible sleeve engagable with the window air conditioning unit preferably includes an elastic periphery and/or a draw string at each outer peripheral end of the sleeve in order to tightly engage with an exterior surface of the air conditioning unit.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
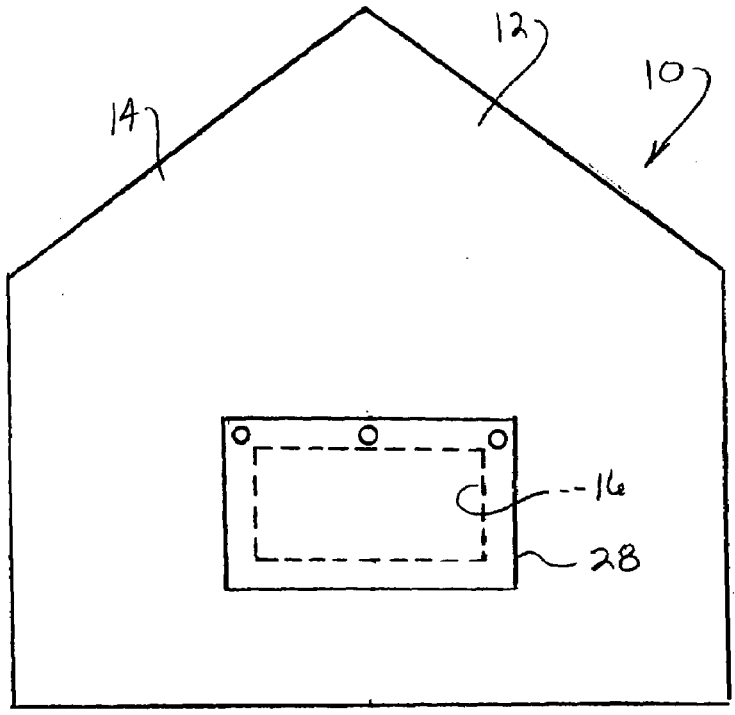
FIG. 1 is a simplified side elevational view of an outdoor enclosure, such as a tent, according to the present invention with an opening through the flexible material of the wall panel and covered with a flap in a closed position using suitable fasteners.
Figure 2:
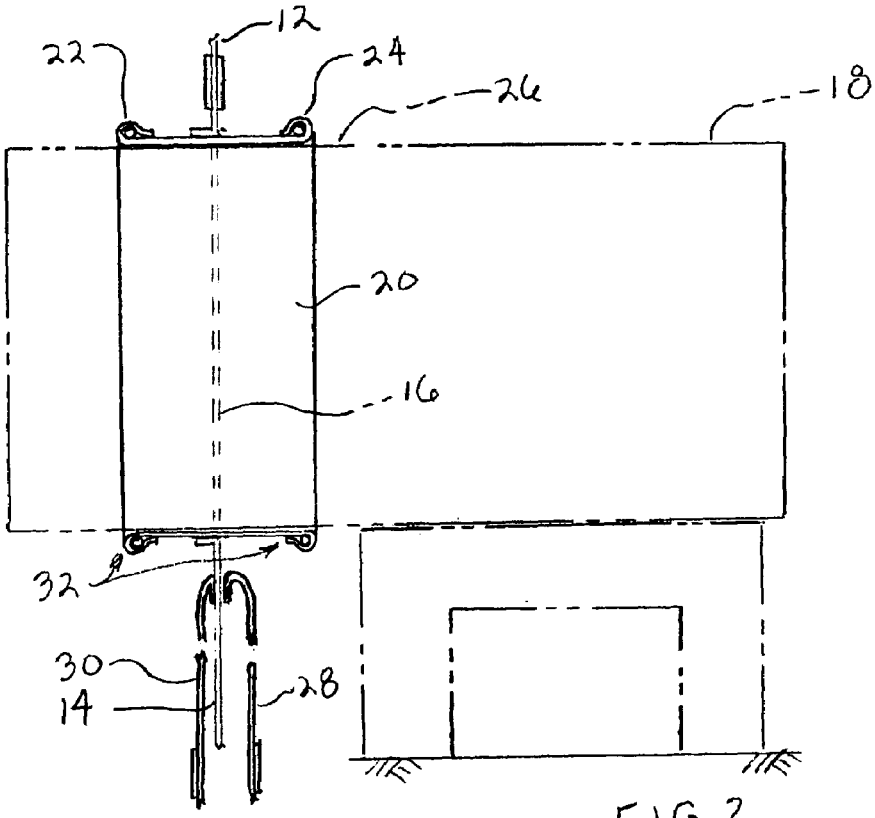
FIG. 2 is a simplified cross-sectional view through the flexible material wall panel of the outdoor enclosure with an air conditioning unit shown in phantom extending through a flexible material sleeve connected to the opening through the wall panel.
Figure 3:
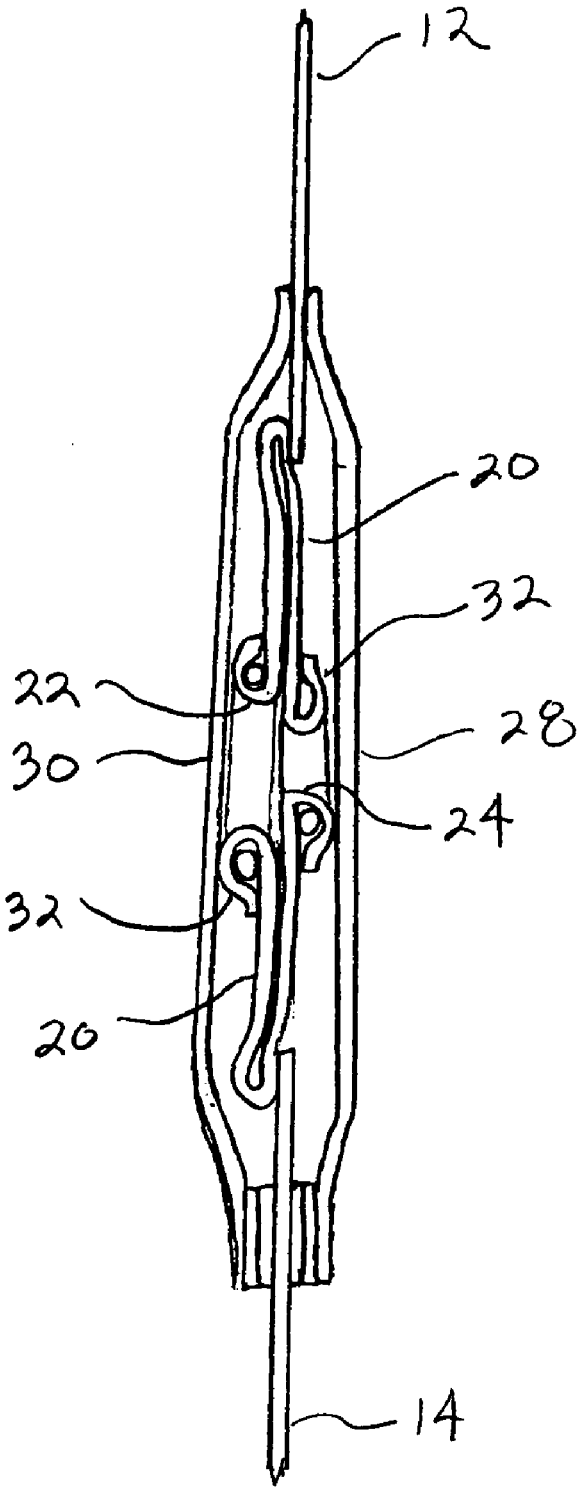
FIG. 3 is a simplified cross-sectional view through the wall panel of the outdoor enclosure with an inner flap and an outer flap in a closed position with the flexible material sleeve stored therebetween.

Referring now to FIGS. 1–3, the present invention relates to a portable outdoor enclosure 10, such as a commercially available tent of any suitable size, structural configuration, and made of any suitable flexible material for protecting occupants from at least some elements of nature. Suitable flexible materials can be inherently water resistant or water proof, or can be treated in order to be sufficiently water resistant or water proof for the desired use. The portable outdoor enclosure 10 can include a wall panel 12 of flexible material forming an outer wall 14 of the enclosure 10. The wall panel 12 can include an aperture or opening 16 formed through the outer wall 14 of sufficient size to allow an air conditioning unit 18 to be inserted through the opening 16. The air conditioning unit 18 can be of any commercially available configuration, such as a window mounted air conditioning unit typically sold for use in apartments and homes. A sleeve 20 of flexible material can be connected to the wall panel 12 in communication with the aperture or opening 16 in the outer wall 14 with at least one outer peripheral end 22 sealingly securable with respect to the air conditioning unit 18 to be installed by engaging the peripheral end 22 of the sleeve 20 against an external surface 26 of the air conditioning unit 18 to be installed through the sleeve 20.

As best seen in FIG. 1, a flap 28 of flexible material can be provided for covering the opening 16 through the wall panel 20 when the air conditioning unit 18 is not installed. The flap 28 can be attached to the wall panel 12 by any suitable fastening method or device. By way of example and not limitation, the flap 28 can be sewn along one peripheral edge, either top, bottom, or one of the two side edges, allowing the flap 28 to be moved away from the opening while in use, and moved to cover the opening when the air conditioning unit 18 is removed. Preferably, the flap 28 includes suitable methods for attaching to the wall panel 12 when in the stored position and/or when in the closed position covering the opening 16 through the wall panel 12 as best seen in FIG. 1. Suitable methods of attaching the flap 28 can include snaps, velcro, zippers, ties, or the like.

Referring now to FIG. 2, an outer flap 28 and inner flap 30 are illustrated in a storage position not covering the opening 16 through the wall panel 12 allowing insertion of an air conditioning unit 18 through the opening 16 and sleeve 20. The sleeve 20 can be engaged with an external surface 26 of the air conditioning unit 18 with means 32 for sealingly engaging at least one outer peripheral end of the sleeve 20 with the exterior surface 26 of the air conditioning unit 18 to be installed through the sleeve 20. The engaging means 32 can include an elastic periphery at one of the peripheral outer ends of the sleeve 20 to tightenly engage with the exterior surface 26 of the air conditioning unit 18 to be installed. Alternatively, the engaging means 32 can include a draw string extending peripherally along the outer peripheral end of the sleeve 20 to tightenly engage with the exterior surface 26 of the air conditioning unit 18 to be installed. Any suitable engaging configuration can be provided in order to allow the user to draw the inner surface of the sleeve into engaging contact with the outer exterior surface of the air conditioning unit.

The sleeve 20 as best seen in FIG. 2 can extend in both an inwardly direction and an outwardly direction with respect to the wall panel 12. The sleeve 20 can include an outer end 24 sealingly securable with respect to the air conditioning unit 18 to be installed by engaging the peripheral outer end 24 of the sleeve 20 against an external surface 26 of the air conditioning unit 18 to be installed through the sleeve 20. Preferably, both outer ends 22, 24 of the sleeve 20 can be provided with means 32 for engaging the exterior surface 26 of the air conditioning unit 18. The engaging means can include, by way of example and not limitation, elastic material sewn into the sleeve along at least a portion of the periphery of the outer end of the sleeve, a draw string extending along at least a portion of the periphery of the outer end of the sleeve, or any other suitable configuration allowing snug engagement of the sleeve with the external surface of the air condition unit.

As best seen in FIG. 3, when provided with an outer flap 28 and an inner flap 30, the sleeve 20 can be stored within the space defined between the inner and outer flaps closing the opening or aperture 16 through the wall panel 12 of the portable outdoor enclosure 10. This permits easy storage of the sleeve when the air conditioning unit 18 is not installed. If desired, the inner flap 30 can be formed of a mesh or screen type of material allowing ventilation of the tent through the aperture in the wall panel 12 when the outer flap is left open.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An outdoor tent enclosure for protecting occupants from at least some elements of nature comprising:

a portable frame suppoeting a flexible material enclosure;

a wall panel of flexible material forming the enclosure and entirely supported by the frame, the wall panel having an opening formed therein of sufficient size to allow an air conditioning unit to be inserted through the opening; and a sleeve of flexible material connected to the wall panel and extending in at least an inwardly direction with respect to the wall panel, the sleeve having at least an inner end sealingly securable with respect to the air conditioning unit to be installed by engaging the peripheral inner end of the sleeve against an external surface of the air conditioning unit to be installed through the sleeve.

2. The outdoor enclosure of claim 1 further comprising:

a flap of flexible material for covering the opening through the wall panel when the air conditioning unit is not installed.

3. The outdoor enclosure of claim 2 further comprising:

means for attaching the flap to the wall panel, wherein the flap is movable between a storage position when not covering the opening through the wall panel and a closed position covering the opening through the wall panel.

4. The outdoor enclosure of claim 1 further comprising:

an outer flap of flexible material located on an outer surface of the wall panel.

5. A portable outdoor enclosure of flexible material for protecting occupants from at least some elements of nature comprising:

a wall panel of flexible material forming an outer wall of the enclosure and having an opening formed therein of sufficient size to allow an air conditioning unit to be inserted through the opening;

a sleeve of flexible material connected to the wall panel and extending in at least an inwardly direction with respect to the wall panel, the sleeve having at least an inner end sealingly securable with respect to the air conditioning unit to be installed by engaging the peripheral inner end of the sleeve against an external surface of the air conditioning unit to be installed through the sleeve;

an outer flap of flexible material located on an outer surface of the wall panel; and an inner flap of flexible material located on an inner surface of the wall panel in order to completely enclose the sleeve of flexible material between the inner flap and outer flap when the sleeve is not in use.

6. The outdoor enclosure of claim 1 further comprising:

the sleeve engagable with the window air conditioning unit including an elastic periphery at the peripheral inner end of the sleeve to tightly engage with an exterior surface of the air conditioning unit to be installed.

7. The outdoor enclosure of claim 1 further comprising:

the sleeve engagable with the window air conditioning unit including a draw string periphery at the peripheral inner end of the sleeve to tightly engage with an exterior surface of the air conditioning unit to be installed.

8. The outdoor enclosure of claim 1 further comprising:

the sleeve extending in an outwardly direction with respect to the wall panel, the sleeve having an outer end sealingly securable with respect to the air conditioning unit to be installed by engaging the peripheral outer end of the sleeve against an external surface of the air conditioning unit to be installed through the sleeve.

9. The outdoor enclosure of claim 8 further comprising:

the sleeve engagable with the window air conditioning unit including an elastic periphery at the peripheral outer end of the sleeve to tightly engage with an exterior surface of the air conditioning unit to be installed.

10. The outdoor enclosure of claim 8 further comprising:

the sleeve engagable with the window air conditioning unit including a draw string periphery at the peripheral outer end of the sleeve to tightly engage with an exterior surface of the air conditioning unit to be installed.

11. In an outdoor tent enclosure for protecting occupants from at least some elements of nature, the enclosure readily convertable from an erected configuration to a more compact disassembled configuration for transportation, a portable, non-air supported wall panel of flexible material forming the enclosure and entirely supported with a portable frame, the improvement comprising:

the wall panel having an opening formed therein of sufficient size to allow an air conditioning unit to be inserted through the opening; and a sleeve of flexible material connected to the wall panel and extending in an inwardly direction and an outwardly direction with respect to the wall panel, the sleeve having an inner end and an outer end sealingly securable with respect to the air conditioning unit to be installed by engaging the peripheral inner end and outer end of the sleeve against an external surface of the air conditioning unit to be installed through the sleeve.

12. The outdoor enclosure of claim 11 further comprising:

a flap of flexible material for covering the opening through the wall panel when the air conditioning unit is not installed.

13. The outdoor enclosure of claim 12 further comprising:

means for attaching the flap to the wall panel, wherein the flap is movable between a storage position when not covering the opening through the wall panel and a closed position covering the opening through the wall panel.

14. The outdoor enclosure of claim 11 further comprising:

an outer flap of flexible material located on an outer surface of the wall panel.

15. A portable outdoor enclosure of flexible material for protecting occupants from at least some elements of nature comprising:

a wall panel of flexible material forming an outer wall of the enclosure and having an opening formed therein of sufficient size to allow an air conditioning unit to be inserted through the opening;

a sleeve of flexible material connected to the wall panel and extending in an inwardly direction and an outwardly direction with respect to the wall panel, the sleeve having an inner end and an outer end sealingly securable with respect to the air conditioning unit to be installed by engaging the peripheral inner end and outer end of the sleeve against an external surface of the air conditioning unit to be installed through the sleeve;

an outer flap of flexible material located on an outer surface of the wall panel; and an inner flap of flexible material located on an inner surface of the wall panel in order to completely enclose the sleeve of flexible material between the inner flap and outer flap when the sleeve is not in use.

16. The outdoor enclosure of claim 11 further comprising:

the sleeve engagable with the window air conditioning unit including an elastic periphery at the peripheral inner end of the sleeve to tightly engage with an exterior surface of the air conditioning unit to be installed.

17. The outdoor enclosure of claim 11 further comprising:

the sleeve engagable with the window air conditioning unit including a draw string periphery at the peripheral inner end of the sleeve to tightly engage with an exterior surface of the air conditioning unit to be installed.

18. The outdoor enclosure of claim 11 further comprising:

the sleeve engagable with the window air conditioning unit including an elastic periphery at the peripheral outer end of the sleeve to tightly engage with an exterior surface of the air conditioning unit to be installed.

19. The outdoor enclosure of claim 11 further comprising:

the sleeve engagable with the window air conditioning unit including a draw string periphery at the peripheral outer end of the sleeve to tightly engage with an exterior surface of the air conditioning unit to be installed.

20. In a portable, non-air-supported outdoor tent enclosure for protecting occupants from at least some elements of nature, the enclosure including structure means for supporting the flexible material distinct and separate from the flexible material and any enclosed volume of air, the supporting structure means giving support and shape to the flexible material, the improvement of the enclosure comprising:

a flexible material side wall defining an enclosed space and having an aperture extending therethrough;

a sleeve connected to and extending through the aperture in the side wall with at least one outer peripheral end of the sleeve spaced from the side wall; and means for sealingly engaging the at least one outer peripheral end of the sleeve with an exterior surface of an air conditioning unit to be installed through the sleeve for conditioning an internal environment within the enclosed space.

* * * * *